US008002015B2

(12) United States Patent
Kwak

(10) Patent No.: US 8,002,015 B2
(45) Date of Patent: Aug. 23, 2011

(54) COOLING SYSTEM FOR LOW PRESSURE CASTING DEVICE

(75) Inventor: Tae-Hwan Kwak, Ulsan (KR)

(73) Assignee: Hyundai Motor Company, Seoul (KR)

( * ) Notice: Subject to any disclaimer, the term of this patent is extended or adjusted under 35 U.S.C. 154(b) by 366 days.

(21) Appl. No.: 12/290,265

(22) Filed: Oct. 29, 2008

(65) Prior Publication Data

US 2009/0250186 A1 Oct. 8, 2009

(30) Foreign Application Priority Data

Apr. 7, 2008 (KR) ..... 10-2008-0032326

(51) Int. Cl.
*B22D 17/06* (2006.01)
*B22D 27/04* (2006.01)

(52) U.S. Cl. ..... 164/306; 164/348

(58) Field of Classification Search ..... 164/113, 164/119, 122, 348, 306, 312
See application file for complete search history.

(56) References Cited

U.S. PATENT DOCUMENTS

| | | | | |
|---|---|---|---|---|
| 6,827,135 | B1 * | 12/2004 | Kramer et al. | 165/104.27 |
| 7,100,672 | B2 * | 9/2006 | Park | 164/312 |
| 2009/0315231 | A1 * | 12/2009 | Furukawa | 266/46 |

FOREIGN PATENT DOCUMENTS

| | | | |
|---|---|---|---|
| JP | 63-299848 | * | 12/1988 |
| JP | 2005-021979 | | 1/2005 |
| KR | 10-2005-0043014 | A | 5/2005 |
| WO | WO 2008/012994 | * | 1/2008 |

* cited by examiner

*Primary Examiner* — Kuang Lin
(74) *Attorney, Agent, or Firm* — Edwards Angell Palmer & Dodge LLP; Peter F. Corless

(57) ABSTRACT

A cooling system for a low pressure casting device, which includes an upper mold provided with a core portion of a spark plug and an upper die, a lower mold provided with a mold portion of a combustion chamber and a lower die, and side molds, may include i) a coolant supply unit connected respectively to the core portion of the spark plug, the upper die, the mold portion of the combustion chamber, and the lower die through coolant supply lines, ii) a cooling air supply unit connected respectively to the side molds and the mold portion of the combustion chamber through air supply lines, and iii) a vacuum intake unit connected respectively to the core portion of the spark plug, the upper die, the mold portion of the combustion chamber, and the lower die through vacuum intake lines.

7 Claims, 6 Drawing Sheets

COOLING SYSTEM FOR LOW PRESSURE CASTING DEVICE

CROSS-REFERENCE TO RELATED APPLICATION

This application claims priority to and the benefit of Korean Patent Application No. 10-2008-0032326 filed on Apr. 7, 2008, the entire contents of which are incorporated herein by reference.

BACKGROUND (a) Technical Field

The present invention relates to a low pressure casting device. More particularly, the present invention relates to a cooling system for a low pressure casting device that cools molds when a cylinder head is cast at a low pressure.

(b) Related Art

A low pressure casting device injects, by feeding pressure of compressed air or inert gas, a molten metal into molds to manufacture casting products such as a cylinder head.

Such a low pressure casting device includes an upper mold, a lower mold, and side molds. A core pin of a spark plug is mounted at the upper mold, and an injection hole for injecting the molten metal and a mold portion of a combustion chamber corresponding to the combustion chamber of a cylinder head are formed at the lower mold.

The low pressure casting device injects the molten metal into an insert space of a core through the injection hole in a state that such molds are set around the core.

In addition, the molten metal injected into the insert space of the core undergoes cold forming and is formed into castings such as a cylinder head.

Meanwhile, cooling efficiency of the molten metal is a key factor in improving productivity of the castings.

According to conventional art, the molten metal is cooled by supplying cold air to a region close to the core pin of the spark plug of the upper mold and the injection hole of the lower mold.

However, since the region close to the core pin of the spark plug and the injection hole is locally cooled, the mold portion of the combustion chamber is not uniformly cooled according to the conventional arts. Accordingly, dendrite arm spacing (DAS) value indicating fineness of metal organization is raised near the combustion chamber of the cylinder head. (If an initial cooling speed of the molten metal is high, the DAS value is low, and vice versa).

As the DAS value is raised, quality of the entire cylinder head as well as mechanical properties such as strain and fatigue strength near the combustion chamber may be deteriorated.

In addition, such local cooling is used for preventing castings from contracting internally according to the conventional art, which causes the cooling cycle of the molten metal to be long. As a result, the cycle of casting processes may become long and productivity of the castings may be decreased according to the conventional art.

The above information disclosed in this Background section is only for enhancement of understanding of the background of the invention and therefore it may contain information that does not form the prior art that is already known in this country to a person of ordinary skill in the art.

SUMMARY

The present invention has been made in an effort to provide a cooling system for a low pressure casting device having advantages of quickly solidifying a molten metal and lowering DAS near a combustion chamber of a cylinder head.

A cooling system for a low pressure casting device that includes an upper mold provided with a core portion of a spark plug and an upper die, a lower mold provided with a mold portion of a combustion chamber and a lower die, and side molds, may include i) a coolant supply unit connected respectively to the core portion of the spark plug, the upper die, the mold portion of the combustion chamber, and the lower die through coolant supply lines, ii) a cooling air supply unit connected respectively to the side molds and the mold portion of the combustion chamber through air supply lines, and iii) a vacuum intake unit connected respectively to the core portion of the spark plug, the upper die, the mold portion of the combustion chamber, and the lower die through vacuum intake lines.

According to the cooling system for the low pressure casting device, the cooling air supply unit may be connected to the core portion of the spark plug, the upper die, and the lower die through separate air supply lines.

According to the cooling system for the low pressure casting device, the vacuum intake unit may include a vacuum tank connected to respective vacuum intake lines so as to collect coolant vapor and coolant from the core portion of the spark plug, the upper die, the mold portion of the combustion chamber, and the lower die, and a vacuum motor connected to the vacuum tank through a first connecting line and generating vacuum pressure in the vacuum tank.

According to the cooling system for the low pressure casting device, the vacuum intake unit may further include a condenser mounted on the first connecting line so as to condense the vapor exhausted from the vacuum tank to the vacuum motor.

According to the cooling system for the low pressure casting device, the vacuum intake unit may further include a gas-liquid separator that is connected to the vacuum motor through a second connecting line and separates the vapor and the liquid discharged from the vacuum motor.

According to the cooling system for the low pressure casting device, the coolant supply unit may include a coolant tank storing the coolant, and a coolant pump connected to the coolant tank and pressure-feeding the coolant to the respective coolant supply lines.

The cooling air supply unit may include an air compressor that compresses air and pressure-feeds the air to the respective air supply lines.

Cut-off valves may be mounted respectively on the coolant supply lines, the air supply lines, and the vacuum intake lines.

The above and other aspects of the invention will be described in detail infra.

BRIEF DESCRIPTION OF THE DRAWINGS

The accompanying drawings are referred to in order to explain an exemplary embodiment of the present invention, but the spirit of the present invention cannot be limited to the accompanying drawings.

DETAILED DESCRIPTION

Hereinafter reference will now be made in detail to various embodiments of the present invention, examples of which are illustrated in the accompanying drawings and described below. As those skilled in the art would realize, the described embodiments may be modified in various different ways, all without departing from the spirit or scope of the present invention.

Figure 1:
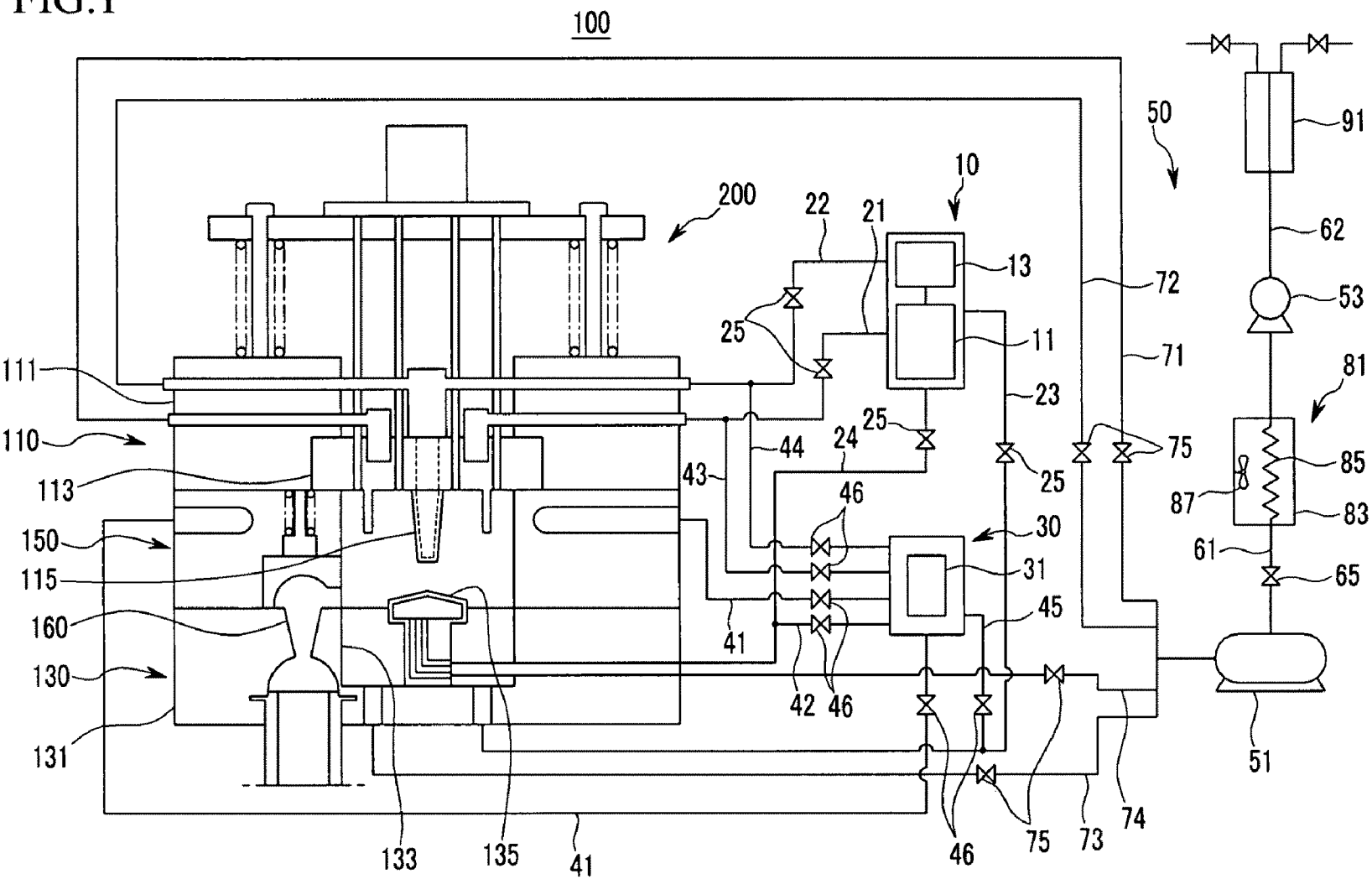
FIG. 1 is a block diagram of a cooling system for a low pressure casting device according to an exemplary embodiment of the present invention.

FIG. 1 is a block diagram of a cooling system for a low pressure casting device according to an exemplary embodiment of the present invention.

A cooling system 100 according to an exemplary embodiment of the present invention is used for cooling molds for a cylinder head of a low pressure casting device 200.

Here, the low pressure casting device 200 includes an upper mold 110, a lower mold 130, and side molds 150.

That is, the low pressure casting device 200 is configured such that a molten metal is injected into an insert space of a core through an injection hole 160 in a state in which such molds 110, 130, and 150 are set around a core (not shown) for forming an interior of the cylinder head.

In this case, the upper mold 110 is provided with an upper die 113 that is supported on an upper base 111, and a core portion 115 of a spark plug that is mounted at the upper die 113.

The lower mold 130 is provided with a lower die 133 that is supported on a lower base 131, and a mold portion 135 of a combustion chamber of the cylinder head (hereinafter, called "mold portion of combustion chamber") that is mounted at the lower die 133.

The side molds 150 are mounted at sides (front, rear, left, and right) of the upper die 113 and the lower die 133.

The cooling system 100 cools the respective molds 110, 130, and 150 of the low pressure casting device 200 with water and air, and exhausts coolant vapor and coolant quickly from the respective molds 110, 130, and 150.

For these purposes, the cooling system 100 includes a coolant supply unit 10, a cooling air supply unit 30, and a vacuum intake unit 50.

The coolant supply unit 10 is configured so as to supply a coolant with a relatively low temperature to a predetermined region of the low pressure casting device 200.

That is, the coolant supply unit 10 supplies the coolant to cooling spaces that include the upper die 113 and the core portion 115 of the spark plug in the upper mold 110, the lower die 133 of the lower mold 130, and the mold portion 135 of the combustion chamber.

Such a coolant supply unit 10 includes a coolant tank 11 storing a predetermined amount of the coolant, and a coolant pump 13 connected to the coolant tank 11.

Here, the coolant pump 13 exhausts the coolant stored in the coolant tank 11 with a predetermined pumping pressure, and pressure-feeds the coolant to the cooling spaces mentioned above. Any known coolant pumps that can exhaust and pressure-feed may be used and detailed description will be omitted accordingly In this case, the coolant pump 13 is respectively connected to the cooling spaces of the upper die 113, the core portion 115 of the spark plug, the lower die 133, and the mold portion 135 of the combustion chamber through different lines.

For example, the coolant pump 13 is connected to the cooling space of the upper die 113 through a first coolant supply line 21, to the cooling space of the core portion 115 of the spark plug through a second coolant supply line 22, to the cooling space of the lower die 133 through a third coolant supply line 23, and to the cooling space of the mold portion 135 of the combustion chamber through a fourth coolant supply line 24.

In addition, a first cut-off valve 25 for selectively opening or closing each of the coolant supply lines 21, 22, 23, and 24 is mounted on each of the coolant supply lines 21, 22, 23, and 24.

Here, the first cut-off valves 25 may be realized as a known solenoid valve that can be controlled to be turned on or off according to electrical signals received from a controller (not shown).

The cooling air supply unit 30 is configured so as to supply cooling air with a relatively low temperature to a predetermined region of the low pressure casting device 200.

That is, the cooling air supply unit 30 supplies the cooling air to cooling spaces that include the side molds 150 and the mold portion 135 of the combustion chamber of the lower mold 130.

Such a cooling air supply unit 30 includes an air compressor 31 that compresses air and selectively exhausts the compressed air. Any known air compressors that can draw in, compress, and store air may be used and detailed description will be omitted accordingly.

The air compressor 31 is respectively connected to the cooling spaces of the side molds 150 and the mold portion 135 of the combustion chamber through different lines.

For instance, the air compressor 31 is connected to the cooling space of the side molds 150 through a first air supply line 41, and to the cooling space of the mold portion 135 of the combustion chamber through a second air supply line 42.

The second air supply line 42 is connected to the fourth coolant supply line 24 such that the cooling air together with the coolant supplied through the fourth coolant supply line 24 by the coolant supply unit 10 is supplied to the mold portion 135 of the combustion chamber.

Further, the cooling air supply unit 30 is respectively connected to the cooling spaces of the upper die 113, the core portion 115 of the spark plug, and the lower die 133 through different lines.

For example, the air compressor 31 is connected to the cooling space of the upper die 113 through a third air supply line 43, to the cooling space of the core portion 115 of the spark plug through a fourth air supply line 44, and to the cooling space of the lower die 133 through a fifth air supply line 45.

Here, the third air supply line 43 is connected to the first coolant supply line 21, the fourth air supply line 44 is connected to the second coolant supply line 22, and the fifth air supply line 45 is connected to the third coolant supply line 23.

Accordingly, when the coolant is supplied to and cools the upper die 113, the core portion 115 of the spark plug, and the lower die 133 by the coolant supply unit 10, moisture remaining in the cooling spaces can be purged by the cooling air.

In addition, a second cut-off valve 46 for selectively opening or closing each of the air supply lines 41, 42, 43, 44, and 45 is mounted on each of the air supply lines 41, 42, 43, 44, and 45.

The second cut-off valves 46 may be realized as a known solenoid valve that can be controlled to be turned on or off according to electrical signals received from a controller (not shown).

The vacuum intake unit 50 is configured so as to draw in the coolant vapor and the coolant from the cooling space of the upper die 113, the core portion 115 of the spark plug, the lower die 133, and the mold portion 135 of the combustion chamber.

That is, the vacuum intake unit 50 generates vacuum pressure and draws in vapor of the coolant having undergone a change of state by heat in the cooling space of the upper die 113, the core portion 115 of the spark plug, the lower die 133, and the mold portion 135 of the combustion chamber.

The vacuum intake unit 50 includes a vacuum tank 51 collecting the coolant vapor and the coolant from the cooling spaces by vacuum pressure, and a vacuum motor 53 generating the vacuum pressure in the vacuum tank 51.

Here, the vacuum tank 51 is a tank of a predetermined capacity that draws in and collects the coolant vapor and the coolant by the vacuum pressure generated by the vacuum motor 53 from the cooling spaces.

In addition, the vacuum motor 53 is connected to the vacuum tank 51 through a first connecting line 61 having a tubular shape. Any known vacuum motor that can generate vacuum pressure in a vacuum tank may be used and detailed description will be omitted accordingly.

In this case, the vacuum tank 51 is respectively connected to the cooling space of the upper die 113, the core portion 115 of the spark plug, the lower die 133, and the mold portion 135 of the combustion chamber through the different lines.

For example, the vacuum tank 51 is connected to the cooling space of the upper die 113 through a first vacuum intake line 71, to the cooling space of the core portion 115 of the spark plug through a second vacuum intake line 72, to the cooling space of the lower die 133 through a third vacuum intake line 73, and to the cooling space of the mold portion 135 of the combustion chamber through a fourth vacuum intake line 74.

A third cut-off valve 75 for selectively opening or closing each of the vacuum intake lines 71, 72, 73, and 74 is mounted on each of the vacuum intake lines 71, 72, 73, and 74.

Here, the third cut-off valve 75 can be realized as any known solenoid valve that can be controlled to be turned on or off according to electrical signals received from a controller (not shown).

The vacuum intake unit 50 may further include a condenser 81 and a gas-liquid separator 91.

The condenser 81 liquefies the vapor exhausted from the vacuum tank 51 by the vacuum motor 53. That is, the condenser 81 reduces a load of the vacuum motor 53 as a consequence of liquefying the vapor having passed through the vacuum tank 51. The condenser 81 may be mounted on the first connecting line 61 that connects the vacuum tank 51 with the vacuum motor 53.

The condenser 81 includes a spiral flowline 85 through which the vapor flows in a case 83, and a fan 87 blowing the cooling air to the flowline 85.

The condenser 81 can be realized as a known heat exchanger that can blow cooling air to a flowline and liquefy a vapor passing through the flowline.

The gas-liquid separator 91 separates liquid from the vapor received from the vacuum motor 53 and exhausts the vapor therefrom.

The gas-liquid separator 91 is connected to the vacuum motor 53 through a second connecting line 62 having a tubular shape. The gas-liquid separator 91 is provided with a separation film that transmits the vapor but not the liquid, and is well known to a person skilled in the art.

Non-described reference numeral 65 in the drawings represents a fourth cut-off valve that is mounted on the first connecting line 61 and selectively opens or closes the first connecting line 61.

Hereinafter, operation of the cooling system 100 for the low pressure casting device according to an exemplary embodiment of the present invention will be described in detail.

A molten metal is injected into the insert space of the core (not shown) through the injection hole 160 in a state in which the upper mold 110, the lower mold 130, and the side molds 150 are set around the core.

Figure 2A:
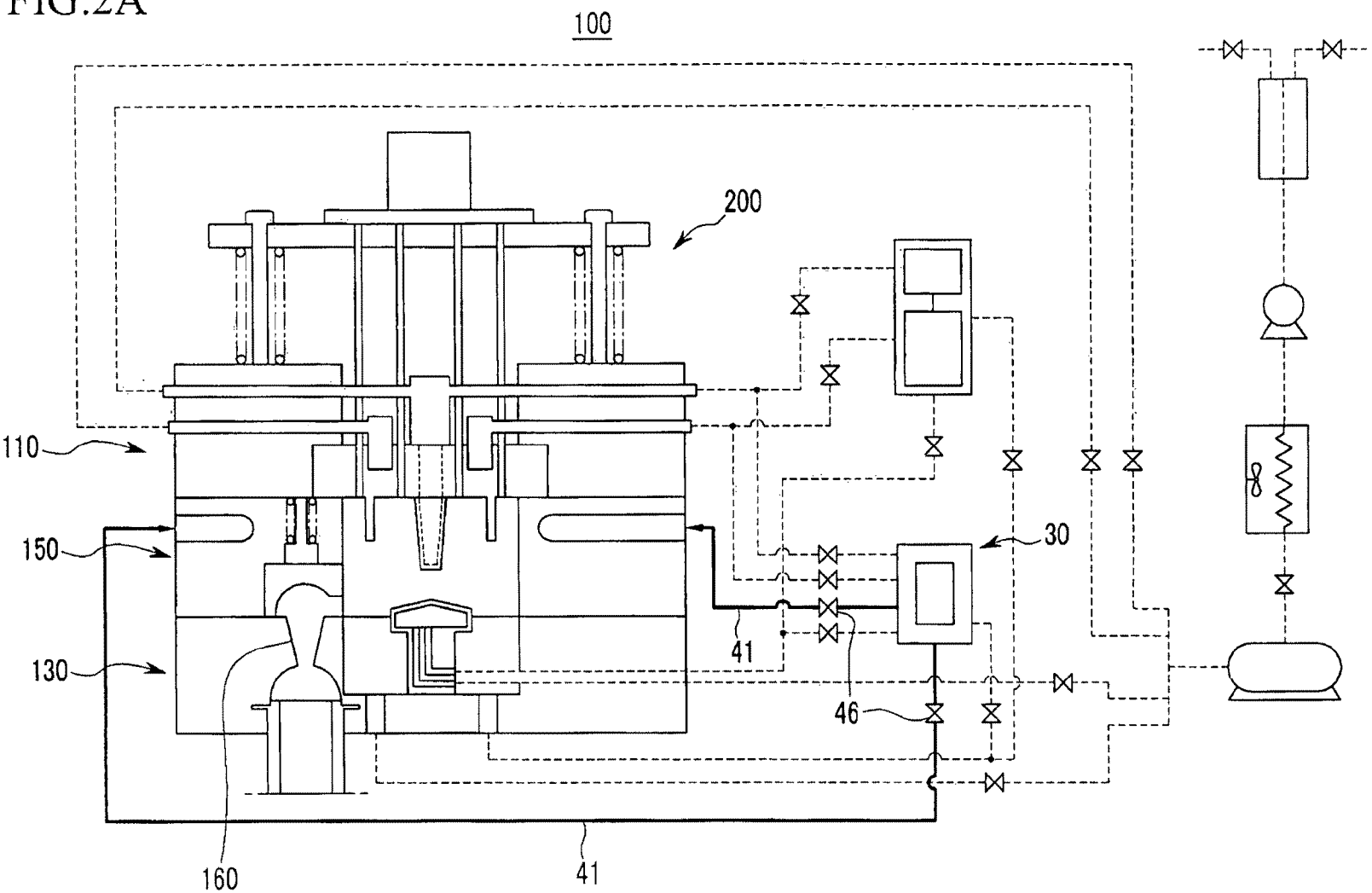
FIG. 2A to FIG. 2C are block diagrams for explaining operation of a cooling system for a low pressure casting device according to an exemplary embodiment of the present invention.

At this stage, as shown in FIG. 2A, the second cut-off valve 46 mounted on the first air supply line 41 receives an electrical signal from the controller (not shown) and opens the first air supply line 41.

Then, the cooling air supply unit 30 supplies the cooling air to the cooling space of the side molds 150 through the first air supply line 41.

Accordingly, the side molds 150 are cooled to a predetermined temperature by the cooling air supplied to the cooling space of the side molds 150.

Figure 2B:
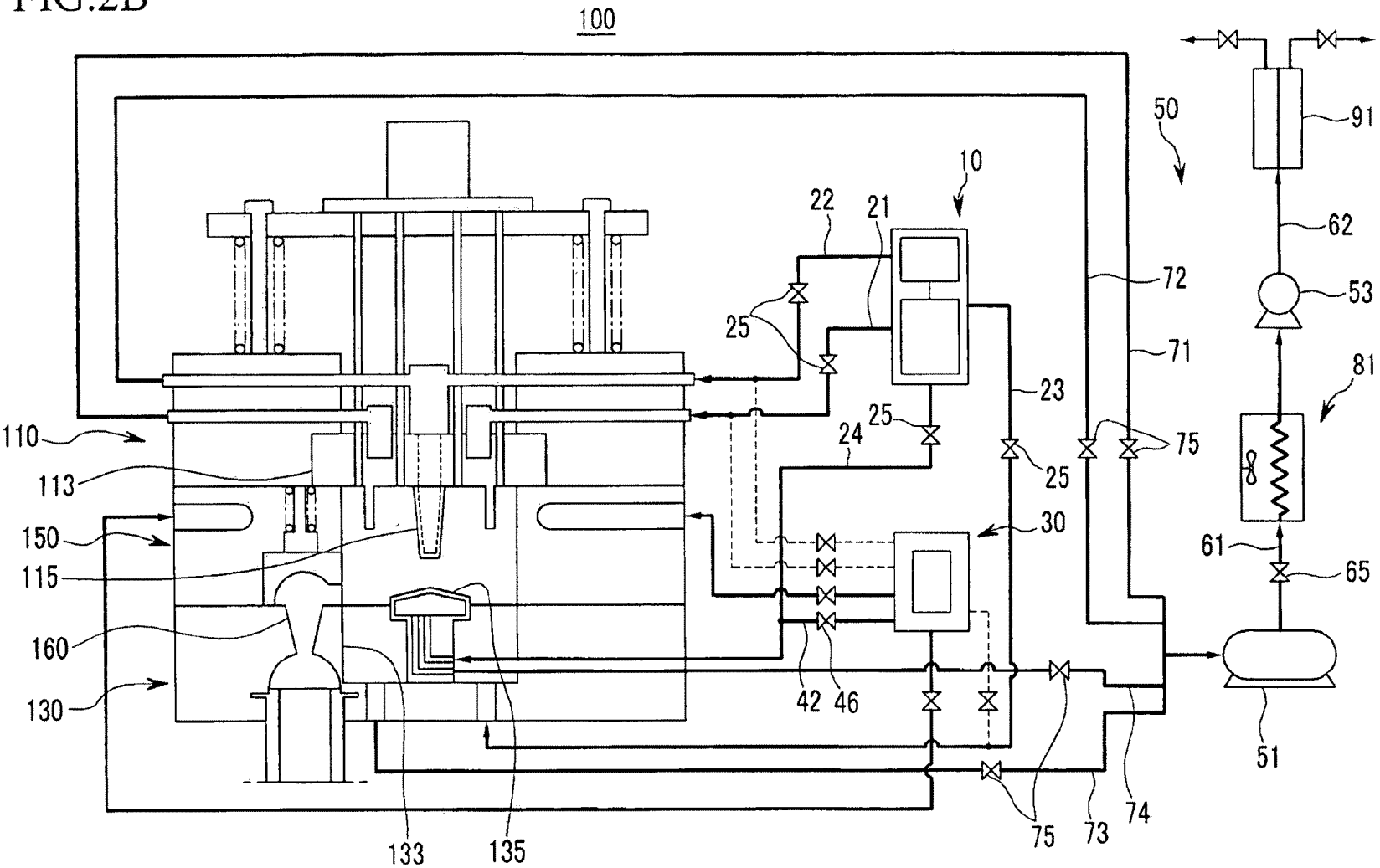

Next, as shown in FIG. 2B, the first cut-off valves 25 mounted on the first coolant supply line 21 and the second coolant supply line 22 receive electrical signals from the controller and open the first coolant supply line 21 and the second coolant supply line 22, respectively.

At this time, the coolant supply unit 10 supplies the coolant to the cooling space of the upper die 113 through the first coolant supply line 21, and supplies the coolant to the cooling space of the core portion 115 of the spark plug through the second coolant supply line 22.

After that, the second cut-off valve 46 mounted on the second air supply line 42 receives an electrical signal from the controller and opens the second air supply line 42.

Accordingly, the cooling air supply unit 30 supplies the cooling air to the cooling space of the mold portion 135 of the combustion chamber through the second air supply line 42.

Next, the first cut-off valves 25 mounted on the third coolant supply line 23 and the fourth coolant supply line 24 receive electrical signals from the controller and open the third coolant supply line 23 and the fourth coolant supply line 24, respectively.

At this time, the coolant supply unit 10 supplies the coolant to the cooling space of the lower die 133 through the third coolant supply line 23, and supplies the coolant to the cooling space of the mold portion 135 of the combustion chamber through the fourth coolant supply line 24.

Since the cooling air is supplied to the cooling space of the mold portion 135 of the combustion chamber through the second air supply line 42 and the coolant is supplied to the cooling space of the mold portion 135 of the combustion chamber through the fourth coolant supply line 24, the coolant is supplied to the mold portion 135 of the combustion chamber as a spray by the cooling air.

At this time, the third cut-off valves 75 receive electrical signals from the controller and open the first, second, third, and fourth vacuum intake lines 71, 72, 73, and 74, and the fourth cut-off valve 65 receives an electrical signal from the controller and opens the first connecting line 61.

In addition, the vacuum motor 53 is operated by an electrical signal of the controller, and accordingly vacuum pressure of about 1.5 kgf is maintained in the vacuum tank 51.

Therefore, the upper die 113 and the core portion 115 of the spark plug of the upper mold 110 are maintained at a predetermined temperature by the coolant as a consequence of the coolant being supplied to the cooling spaces thereof.

In addition, the mold portion 135 of the combustion chamber of the lower mold 130 is maintained at a predetermined temperature as a consequence of the cooling air being supplied to the cooling space thereof, and the coolant is supplied as a spray to the cooling space thereof.

In this case, since the coolant as a spray is supplied to the cooling space of the mold portion 135 of the combustion chamber by the cooling air, thermal shock does not occur quickly at a boundary surface of the molten metal corresponding to the mold portion 135 of the combustion chamber.

In addition, the lower die 133 of the lower mold 130 is maintained at a predetermined temperature as a consequence of the coolant being supplied to the cooling space thereof.

In the conventional art, regions near the core portion 115 of the spark plug of the upper mold 110 and the injection hole 160 of the lower mold 130 are locally cooled by the cooling air; in contrast, according to the present systems, all molds including the upper mold 110, the lower mold 130, and the side molds 150 are cooled with water and air, which makes it possible to solidify the molten metal quickly.

Accordlingly, the cooling cycle may be greatly shortened according to an exemplary embodiment of the present invention. For example, the entire cycle of the casting process according to the conventional arts is 600 sec, but that of the casting processes according to an exemplary embodiment of the present invention may be 400 sec. As a result, productivity of casting may be improved and production cost may be curtailed.

In addition, DAS indicating fineness of metal organization near the combustion chamber of the cylinder head may be lowered since the cooling speed of the molten metal is fast. Due to the low DAS, grains near the combustion chamber of the cylinder head can be minute and metal organization can be fine. As a result, mechanical properties and quality of the cylinder head may be improved.

Figure 3A:
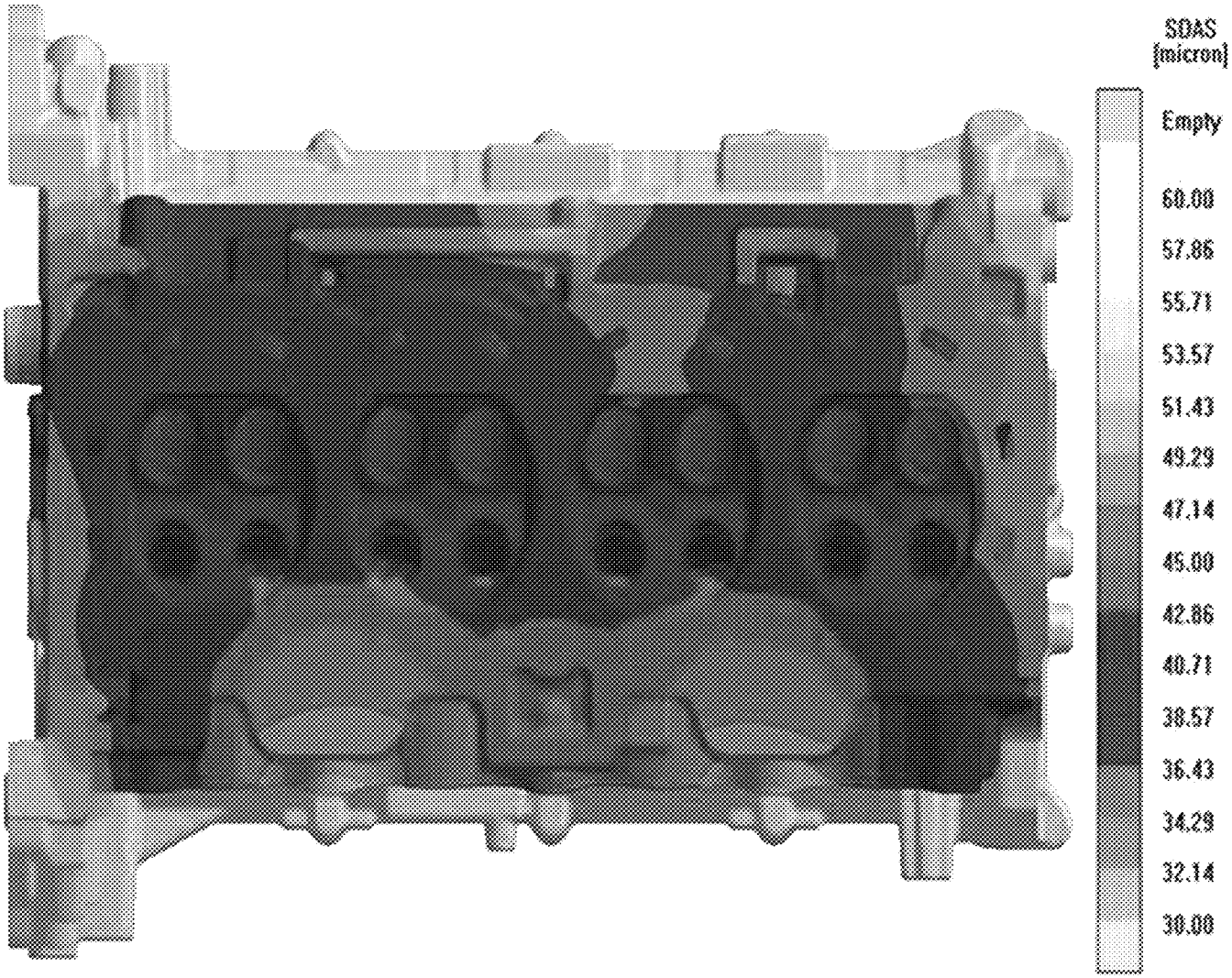
FIG. 3A shows DAS of a cylinder head manufactured by applying a cooling system for a low pressure casting device according to an exemplary embodiment of the present invention.
Figure 3B:
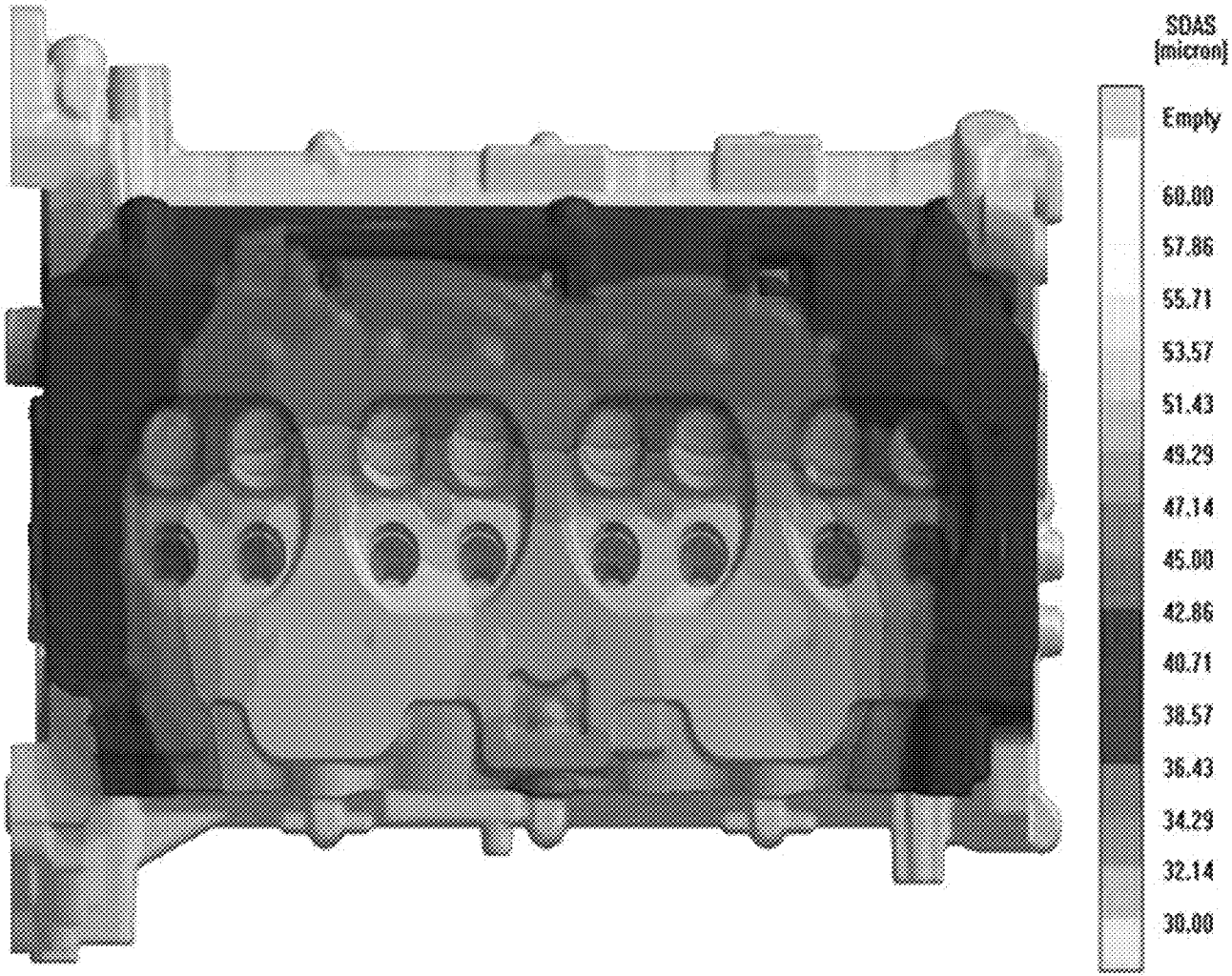
FIG. 3B shows DAS of a cylinder head manufactured according to conventional arts.

For example, if the cylinder head is cast according to an exemplary embodiment of the present invention where the upper mold 110, the lower mold 130, and the side molds 150 are cooled with water and air, the DAS near the combustion chamber of the cylinder head is lower than or equal to 40 μm, as shown in FIG. 3A. On the contrary, if the cylinder head is cast according to the conventional arts where the regions near the core portion 115 of the spark plug of the upper mold 110 and the injection hole 160 of the lower mold 130 are locally cooled by the cooling air, the DAS near the combustion chamber of the cylinder head is 50-60 μm, as shown in FIG. 3B.

Since the DAS is low when initial cooling speed of the molten metal is fast, it can be known that the initial cooling speed of the molten metal according to an exemplary embodiment of the present invention is faster than that of the molten metal according to the conventional arts as a consequence of the upper mold 110, the lower mold 130, and the side molds 150 being cooled with water and air.

Meanwhile, the coolant vapor and the coolant in the cooling space of the upper die 113, the core portion 115 of the spark plug, the lower die 133, and the mold portion 135 of the combustion chamber are drawn into the vacuum tank 51 through the first, second, third, and fourth vacuum intake lines 71, 72, 73, and 74 by the operation of the vacuum motor 53.

After that, the coolant vapor and the coolant are supplied to the vacuum motor 53 through the first connecting line 61, and the vapor is liquefied by the condenser 81 in this process.

In addition, while passing the gas-liquid separator 91 through the second connecting line 62, the vapor and the liquid exhausted from the vacuum motor 53 are separated from each other and are exhausted.

Since the coolant vapor and the coolant are drawn in through the vacuum intake unit 50 with the vacuum pressure according to an exemplary embodiment of the present invention, the risk of leakage at the molds may be eliminated.

In addition, oxidation and cavitation of the castings caused by the leakage of the coolant may be prevented, and delay, blockage, and irregularity of coolant flow caused by the vapor may also be prevented according to an exemplary embodiment of the present invention.

Therefore, the cooling cycle of the molten metal may be greatly shortened and cooling efficiency of the molds may be further improved according to an exemplary embodiment of the present invention.

Figure 2C:
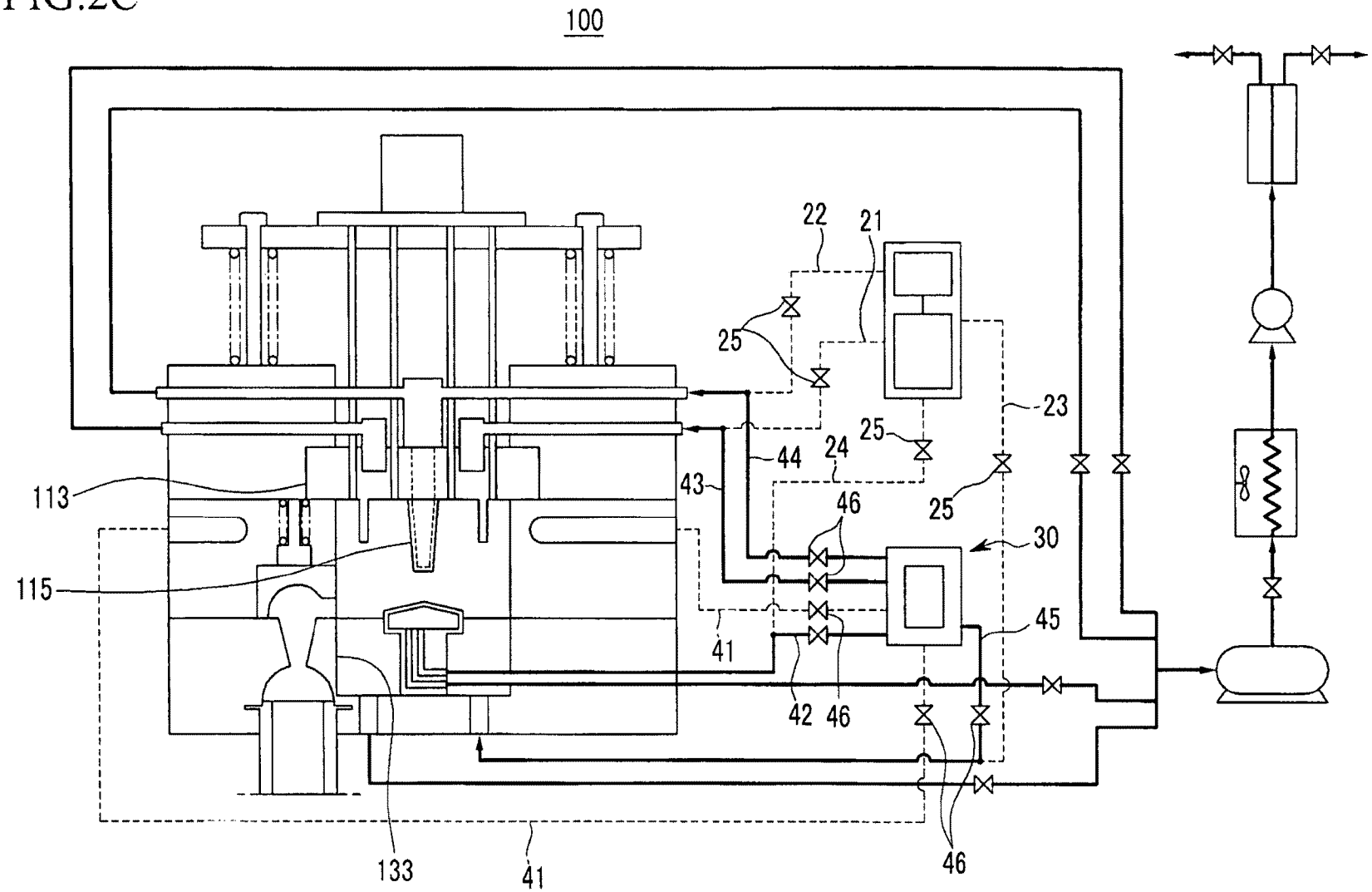

After the processes described above, the first cut-off valves 25 mounted on the first coolant supply line 21 and the second coolant supply line 22 receive electrical signals from the controller and close the first coolant supply line 21 and the second coolant supply line 22, as shown in FIG. 2C.

In addition, the first cut-off valves 25 mounted on the third coolant supply line 23 and the fourth coolant supply line 24 receive electrical signals from the controller and close the third coolant supply line 23 and the fourth coolant supply line 24.

Further, the second cut-off valve 46 mounted on the first air supply line 41 receives an electrical signal from the controller and closes the first air supply line 41.

At this stage, the second cut-off valves 46 mounted on the third air supply line 43, the fourth air supply line 44, and the fifth air supply line 45 receive electrical signals from the controller and open the third air supply line 43, the fourth air supply line 44, and the fifth air supply line 45, respectively.

Then, the cooling air supply unit 30 supplies the cooling air to the cooling space of the upper die 113 through the third air supply line 43, supplies the cooling air to the cooling space of the core portion 115 of the spark plug through the fourth air supply line 44, and supplies the cooling air to the cooling space of the lower die 133 through the fifth air supply line 45.

Accordingly, moisture remained in the cooling spaces is exhausted to the exterior by the cooling air.

Finally, the second cut-off valves 46 close the second air supply line 42, the third air supply line 43, the fourth air supply line 44, and the fifth air supply line 45, and the low pressure casting process using an exemplary embodiment of the present invention is completed.

According to the present invention, as described above, a molten metal can be quickly solidified, cooling cycle can be greatly shortened, casting productivity can be increased, production cost can be reduced, mechanical properties and quality of a casting product can be improved, and risk of leakage at molds, delay and problems of block, irregularity of coolant flow caused by the vapor cab prevented/eliminated.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A cooling system for a low pressure casting device that comprises an upper mold provided with a core portion of a spark plug and an upper die, a lower mold provided with a mold portion of a combustion chamber and a lower die, and side molds, the cooling system comprising:

a liquid coolant supply unit connected respectively to the core portion of the spark plug, the upper die, the mold portion of the combustion chamber, and the lower die through coolant supply lines, the coolant supply lines having a first coolant supply line for supplying coolant to a coolant space of the upper die, a second coolant supply line for supplying coolant to a cooling space of the core portion of the spark plug, a third coolant supply line for supplying coolant to a cooling space of the lower die, and a forth coolant supply for supplying coolant to a cooling space of the mold portion of the combustion chamber;

a cooling air supply unit connected respectively to the side molds and the mold portion of the combustion chamber through air supply lines, the air supply lines having a first air supply line for supplying compressed air to a cooling space of the side molds, a second air supply line for supplying compressed air to the cooling of the combustion chamber, a third air supply line for supplying compressed air to the cooling space of the core portion of the upper die, a fourth air supply line for supplying compressed air to the cooling space of the core portion of the spark plug, and a fifth air supply line for supplying compressed air to the cooling space of the lower die: and a vacuum intake unit connected respectively to the core portion of the spark plug, the upper die, the mold portion of the combustion chamber, and the lower die through vacuum intake lines.

2. The cooling system of claim 1, wherein the vacuum intake unit comprises:

a vacuum tank connected to respective vacuum intake lines for collecting coolant vapor and coolant from the core portion of the spark plug, the upper die, the mold portion of the combustion chamber, and the lower die; and a vacuum motor connected to the vacuum tank through a first connecting line for generating vacuum pressure in the vacuum tank.

3. The cooling system of claim 2, wherein the vacuum intake unit further comprises a condenser mounted on the first connecting line for condensing the vapor exhausted from the vacuum tank to the vacuum motor.

4. The cooling system of claim 3, wherein the vacuum intake unit further comprises a gas-liquid separator that is connected to the vacuum motor through a second connecting line for separating the vapor and the liquid discharged from the vacuum motor.

5. The cooling system of claim 1, wherein the coolant supply unit comprises:

a coolant tank storing the coolant; and a coolant pump connected to the coolant tank for pressure-feeding the coolant to the respective coolant supply lines.

6. The cooling system of claim 1, wherein the cooling air supply unit comprises an air compressor for compressing air and pressure-feeding the compressed air to the respective air supply lines.

7. The cooling system of claim 1, wherein cut-off valves are mounted respectively on the coolant supply lines, the air supply lines, and the vacuum intake lines.

* * * * *